US008345900B2

(12) United States Patent
Marquis et al.

(10) Patent No.: US 8,345,900 B2
(45) **Date of Patent: *Jan. 1, 2013**

(54) METHOD AND SYSTEM FOR PROVIDING HEARING ASSISTANCE TO A USER

(75) Inventors: Francois Marquis, Corminboeuf (CH); Benjamin Heldner, Murten (CH); Fabian Nater, Wiesen (CH); Giuseppina Biundo Lotito, Neuchatel (CH); Roman Arnet, Winterthur (CH)

(73) Assignee: Phonak AG, Stafa (CH)

( * ) Notice: Subject to any disclaimer, the term of this patent is extended or adjusted under 35 U.S.C. 154(b) by 201 days.

This patent is subject to a terminal disclaimer.

(21) Appl. No.: 12/599,676

(22) PCT Filed: May 10, 2007

(86) PCT No.: PCT/EP2007/004160

§ 371 (c)(1),
(2), (4) Date: Oct. 26, 2010

(87) PCT Pub. No.: WO2008/138365

PCT Pub. Date: Nov. 20, 2008

(65) Prior Publication Data

US 2011/0044481 A1 Feb. 24, 2011

(51) Int. Cl.
*H04R 25/00* (2006.01)

(52) U.S. Cl. ..... 381/313; 381/312; 381/315

(58) Field of Classification Search ..... 381/312–313, 381/315–321, 331
See application file for complete search history.

(56) References Cited

FOREIGN PATENT DOCUMENTS

| | | |
|---|---|---|
| EP | 1370112 | * 12/2003 |
| EP | 1691574 | * 6/2006 |

* cited by examiner

*Primary Examiner* — Suhan Ni
(74) *Attorney, Agent, or Firm* — Conley Rose, P.C.

(57) ABSTRACT

There is provided a method for providing hearing assistance to a user (101, 301), comprising: capturing audio signals by a microphone arrangement (26) comprising at least two spaced apart microphones (M1, M2); estimating the total energy contained in the voice spectrum of the audio signals captured at least one of the microphones; estimating the value of the direction of arrival of the captured audio signals by comparing the audio signals captured by at least two of the spaced apart microphones; judging whether a voice is present close to microphone arrangement by taking into account the estimated total energy contained in the voice spectrum of the captured audio signals and the estimated value of the direction of arrival of the captured audio signals; outputting a signal representative of said judgement; processing said captured audio signals according to said signal representative of said judgement; and stimulating the user's hearing, by stimulating means worn at or in at least one of the user's ears (39), according to the processed audio signals.

34 Claims, 7 Drawing Sheets

METHOD AND SYSTEM FOR PROVIDING HEARING ASSISTANCE TO A USER

CROSS-REFERENCE TO RELATED APPLICATIONS

The present application is a National Phase entry of PCT Application No. PCT/EP2007/004160, filed 10 May 2007, which is incorporated herein by reference in its entirety.

STATEMENT REGARDING FEDERALLY SPONSORED RESEARCH OR DEVELOPMENT

Not applicable.

BACKGROUND

1. Field of the Invention

The present invention relates to a method for providing hearing assistance to a user; it also relates to a corresponding system. In particular, the invention relates to a system comprising a microphone arrangement for capturing audio signals, audio signal processing means and means for stimulating the hearing of the user according to the processed audio signals.

2. Description of Related Art

One type of hearing assistance systems is represented by wireless systems, wherein the microphone arrangement is part of a transmission unit for transmitting the audio signals via a wireless audio link to a receiver unit comprising or being connected to the stimulating means. Usually in such systems the wireless audio link is an narrow band FM radio link. The benefit of such systems is that sound captured by a remote microphone at the transmission unit can be presented at a much better SNR to user wearing the receiver unit at his ear(s).

According to one typical application of such wireless audio systems, the stimulating means is loudspeaker which is part of the receiver unit or is connected thereto. Such systems are particularly helpful in teaching environments for normal-hearing children suffering from auditory processing disorders (APD), wherein the teacher's voice is captured by the microphone of the transmission unit, and the corresponding audio signals are transmitted to and are reproduced by the receiver unit worn by the child, so that the teacher's voice can be heard by the child at an enhanced level, in particular with respect to the background noise level prevailing in the classroom. It is well known that presentation of the teacher's voice at such enhanced level supports the child in listening to the teacher.

According to another typical application of wireless audio systems the receiver unit is connected to or integrated into a hearing instrument, such as a hearing aid. The benefit of such systems is that the microphone of the hearing instrument can be supplemented or replaced by the remote microphone which produces audio signals which are transmitted wirelessly to the FM receiver and thus to the hearing instrument. In particular, FM systems have been standard equipment for children with hearing loss in educational settings for many years. Their merit lies in the fact that a microphone placed a few inches from the mouth of a person speaking receives speech at a much higher level than one placed several feet away. This increase in speech level corresponds to an increase in signal-to-noise ratio (SNR) due to the direct wireless connection to the listener's amplification system. The resulting improvements of signal level and SNR in the listener's ear are recognized as the primary benefits of FM radio systems, as hearing-impaired individuals are at a significant disadvantage when processing signals with a poor acoustical SNR.

Most FM systems in use today provide two or three different operating modes. The choices are to get the sound from: (1) the hearing instrument microphone alone, (2) the FM microphone alone, or (3) a combination of FM and hearing instrument microphones together.

Usually, most of the time the FM system is used in mode (3), i.e. the FM plus hearing instrument combination (often labeled "FM+M" or "FM+ENV" mode). This operating mode allows the listener to perceive the speaker's voice from the remote microphone with a good SNR while the integrated hearing instrument microphone allows to listener to also hear environmental sounds. This allows the user/listener to hear and monitor his own voice, as well as voices of other people or environmental noise, as long as the loudness balance between the FM signal and the signal coming from the hearing instrument microphone is properly adjusted. The so-called "FM advantage" measures the relative loudness of signals when both the FM signal and the hearing instrument microphone are active at the same time. As defined by the ASHA (American Speech-Language-Hearing Association 2002), FM advantage compares the levels of the FM signal and the local microphone signal when the speaker and the user of an FM system are spaced by a distance of two meters. In this example, the voice of the speaker will travel 30 cm to the input of the FM microphone at a level of approximately 80 dB-SPL, whereas only about 65 dB-SPL will remain of this original signal after traveling the 2 m distance to the microphone in the hearing instrument. The ASHA guidelines recommend that the FM signal should have a level 10 dB higher than the level of the hearing instrument's microphone signal at the output of the user's hearing instrument.

When following the ASHA guidelines (or any similar recommendation), the relative gain, i.e. the ratio of the gain applied to the audio signals produced by the FM microphone and the gain applied to the audio signals produced by the hearing instrument microphone, has to be set to a fixed value in order to achieve e.g. the recommended FM advantage of 10 dB under the above-mentioned specific conditions. Accordingly, heretofore—depending on the type of hearing instrument used—the audio output of the FM receiver has been adjusted in such a way that the desired FM advantage is either fixed or programmable by a professional, so that during use of the system the FM advantage—and hence the gain ratio—is constant in the FM+M mode of the FM receiver.

EP 0 563 194 B1 relates to a hearing system comprising a remote microphone/transmitter unit, a receiver unit worn at the user's body and a hearing aid. There is a radio link between the remote unit and the receiver unit, and there is an inductive link between the receiver unit and the hearing aid. The remote unit and the receiver unit each comprise a microphone, with the audio signals of theses two microphones being mixed in a mixer. A variable threshold noise-gate or voice-operated circuit may be interposed between the microphone of the receiver unit and the mixer, which circuit is primarily to be used if the remote unit is in a line-input mode, i.e. the microphone of the receiver then is not used.

WO 97/21325 A1 relates to a hearing system comprising a remote unit with a microphone and an FM transmitter and an FM receiver connected to a hearing aid equipped with a microphone. The hearing aid can be operated in three modes, i.e. "hearing aid only", "FM only" or "FM+M". In the FM+M mode the maximum loudness of the hearing aid microphone audio signal is reduced by a fixed value between 1 and 10 dB below the maximum loudness of the FM microphone audio signal, for example by 4 dB. Both the FM microphone and the hearing aid microphone may be provided with an automatic gain control (AGC) unit.

WO 2004/100607 A1 relates to a hearing system comprising a remote microphone, an FM transmitter and left- and right-ear hearing aids, each connected with an FM receiver. Each hearing aid is equipped with a microphone, with the audio signals from a remote microphone and the respective hearing aid microphone being mixed in the hearing aid. One of the hearing aids may be provided with a digital signal processor which is capable of analyzing and detecting the presence of speech and noise in the input audio signal from the FM receiver and which activates a controlled inverter if the detected noise level exceeds a predetermined limit when compared to the detected level, so that in one of the two hearing aids the audio signal from the remote microphone is phase-inverted in order to improve the SNR.

WO 02/30153 A1 relates to a hearing system comprising an FM receiver connected to a digital hearing aid, with the FM receiver comprising a digital output interface in order to increase the flexibility in signal treatment compared to the usual audio input parallel to the hearing aid microphone, whereby the signal level can easily be individually adjusted to fit the microphone input and, if needed, different frequency characteristics can be applied. However, is not mentioned how such input adjustment can be done.

Usually FM or inductive receivers are equipped with a squelch function by which the audio signal in the receiver is muted if the level of the demodulated audio signal is too low in order to avoid user's perception of excessive noise due a too low sound pressure level at the remote microphone or due to a large distance between the transmission unit and the receiver unit exceeding the reach of the FM link, see for example EP 0 671 818 B1 and EP 1 619 926 A1. Contemporary digital hearing aids are capable of permanently performing a classification of the present auditory scene captured by the hearing aid microphones in order to select that hearing aid operation mode which is most appropriate for the determined present auditory scene. Examples of such hearing aids including auditory scene analysis can be found in US 2002/0037087, US 2002/0090098, WO 02/032208 and US 2002/0150264.

Further, binaural hearing systems are available, wherein there is provided a usually wireless link between the right ear hearing aid and the left ear hearing aid for exchanging data and audio signals between the hearing aids for improving binaural perception of sound. Examples of such binaural systems can be found in EP 1 651 005 A2, US 2004/0037442 A1 and U.S. Pat. No. 6,549,633 B1. In EP 1 531 650 A2 a binaural system is described wherein in addition to the binaural link a wireless audio link to a remote microphone is provided. A similar system is described in WO 02/074011 A2.

Hearing aids comprising an acoustic beam-former are described, for example, in EP 1 005 783 B1, EP 1 269 576 B1, EP 1 391 138 B1, EP 1 303 166 A2 and WO 00/68703.

According to EP 1 303 166 A2 and WO 00/68703, the direction of the formed acoustic beam is controlled by the measured direction of arrival (DOA) of the sound captured by the microphones. The DOA can be estimated by comparing the audio signals captured by a plurality of spaced apart microphones, for example, by comparing the respective phases. If the microphones are directional microphones, the DOA may be calculated by forming level ratios of the audio signals, see, for example, WO 00/68703. With two microphones the DOA can be estimated in two dimensions, and with three microphones the DOA can be estimated in three dimensions.

According to EP 1 303 166 A2 the audio signal processing is switched from an omni-directional mode to a directional mode once the voice of a certain speaker has been recognized by identifying the speaker from a plurality of known speakers. The DOA of the voice of the speaker is estimated and the result is used to set the beam former such that it points into this direction.

EP 1 320 281 A2 relates to a binaural hearing system comprising a beam former, which is controlled by the DOA determined separately for each of the left ear unit and the right ear unit, which each are provided with two spaced-apart microphones.

EP 1 691 574 A2 relates to a wireless system, wherein the transmission unit comprises two spaced-apart microphones, a beam former and a classification unit for controlling the gain applied in the receiver unit to the transmitted audio signals according to the presently prevailing auditory scene. The classification unit generates control commands which are transmitted to the receiver unit via a common link together with the audio signals. The receiver unit may be part of or connected to a hearing instrument. The classification unit comprises a voice energy estimator and a surrounding noise level estimator in order to decide whether there is a voice close to the microphones or not, with the gain to be applied in the receiver unit being set accordingly. The voice energy estimator uses the output signal of the beam former for determining the total energy contained in the voice spectrum.

It is an object of the invention to provide for a hearing assistance system and method which allows for particularly reliable detection of the presence of a voice source close to the microphone arrangement.

SUMMARY OF THE INVENTION

According to the invention, this object is achieved by a method as defined in claim 1 and by a system as defined in claim 34, respectively.

The invention is beneficial in that, by taking into account both the estimated total energy contained in the voice spectrum of the audio signals and the estimated value of the direction of arrival of the audio signals when judging whether a voice is present close to the microphone arrangement, a high reliability of the detection of close voice can be achieved.

According to one embodiment, the audio signals are transmitted by a transmission unit via a wireless audio link to a receiver unit comprising a gain control unit, with the gain applied to the received audio signals being set according to the presence or lack of close voice, as judged from the captured audio signals. The transmission unit comprises the microphone arrangement. The receiver unit may comprise the stimulating means or it may be connected to integrated in a hearing instrument.

According to an alternative embodiment, at least one of the microphones of the microphone arrangement is part of a right ear hearing instrument and at least one of the microphones of the microphone arrangement is part of a left ear hearing instrument, with the audio signals captured by the microphone of each of the hearing instruments being transmitted via a preferably wireless audio link to the respective other one of the hearing instruments.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

A first example of the invention is illustrated in FIGS. 1 to 6.

Figure 1:
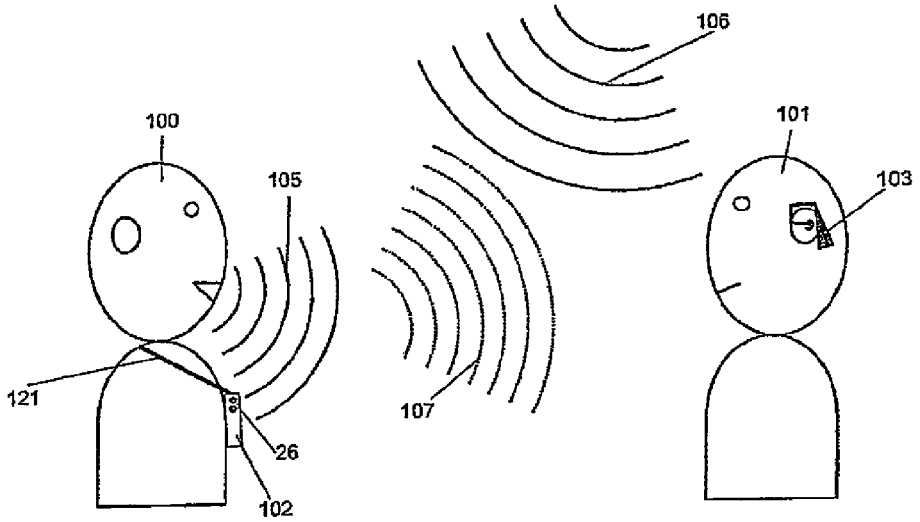
FIG. 1 is a schematic view of the use of a first embodiment of a hearing assistance system according to the invention.
Figure 5:
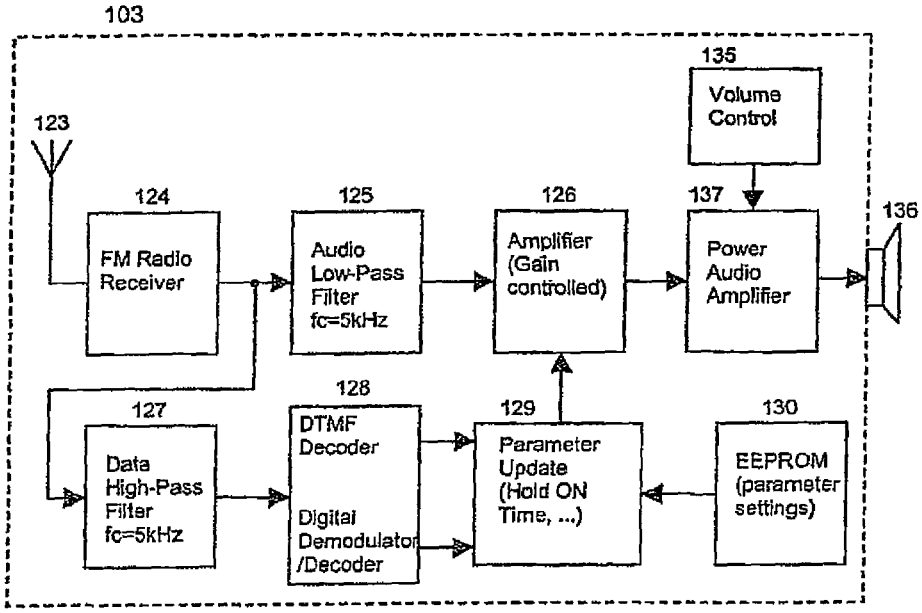
FIG. 5 is a block diagram of the receiver unit of the system of FIG. 1.

FIG. 1 shows schematically the use of a system for hearing assistance comprising an FM radio transmission unit 102 comprising a directional microphone arrangement 26 consisting of two omnidirectional microphones M1 and M2 which are spaced apart by a distance d, and an FM radio receiver unit 103 comprising a loudspeaker 136 (shown only in FIG. 5). While the microphone arrangement preferably consists of at least two spaced apart microphones, it could generally also consist of more than two microphones. The transmission unit 102 is worn by a speaker 100 around his neck by a neck-loop 121 acting as an FM radio antenna, with the microphone arrangement 26 capturing the sound waves 105 carrying the speaker's voice. Audio signals and control data are sent from the transmission unit 102 via radio link 107 to the receiver unit 103 worn by a user/listener 101. In addition to the voice 105 of the speaker 100 background/surrounding noise 106 may be present which will be both captured by the microphone arrangement 26 of the transmission unit 102 and the ears of the user 101. Typically the speaker 100 will be a teacher and the user 101 will be a normal-hearing child suffering from APD, with background noise 106 being generated by other pupils.

Figure 2:
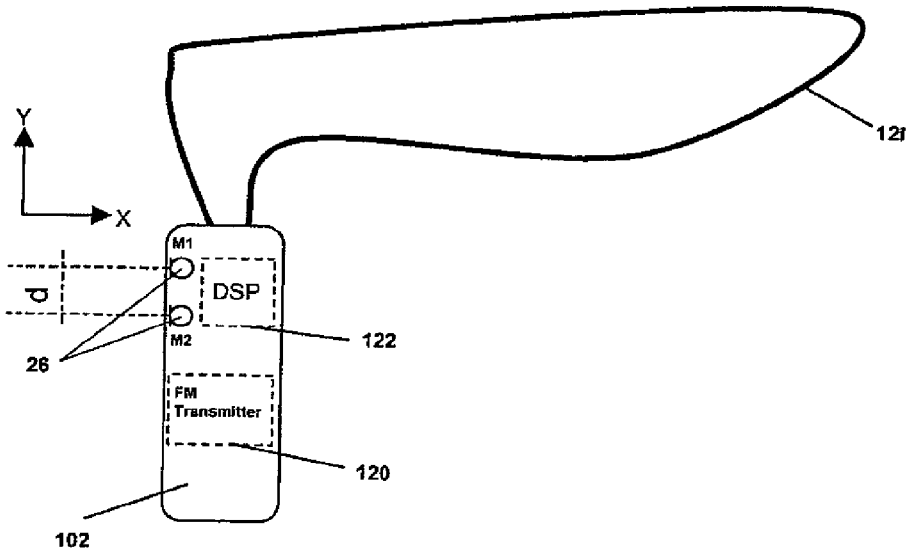
FIG. 2 is a schematic view of the transmission unit of the system of FIG. 1.

FIG. 2 is a schematic view of the transmission unit 102 which, in addition to the microphone arrangement 26, comprises a digital signal processor 122 and an FM transmitter 120.

Figure 3:
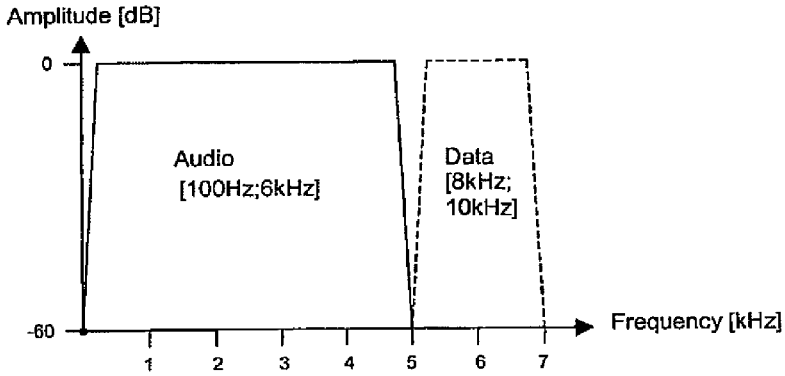
FIG. 3 is a diagram showing the signal amplitude versus frequency of the common audio signal/data transmission channel of the system of FIG. 1.

According to FIG. 3, the channel bandwidth of the FM radio transmitter 120, which, for example, may range from 100 Hz to 10 kHz, is split in two parts ranging, for example from 100 Hz to 6 kHz and from 8 kHz to 10 kHz, respectively. In this case, the lower part is used to transmit the audio signals (i.e. the first audio signals) resulting from the microphone arrangement 26, while the upper part is used for transmitting data from the FM transmitter 120 to the receiver unit 103. The data link established thereby can be used for transmitting control commands relating to the gain to be set by the receiver unit 103 from the transmission unit 102 to the receiver unit 103, and it also can be used for transmitting general information or commands to the receiver unit 103.

Figure 4:
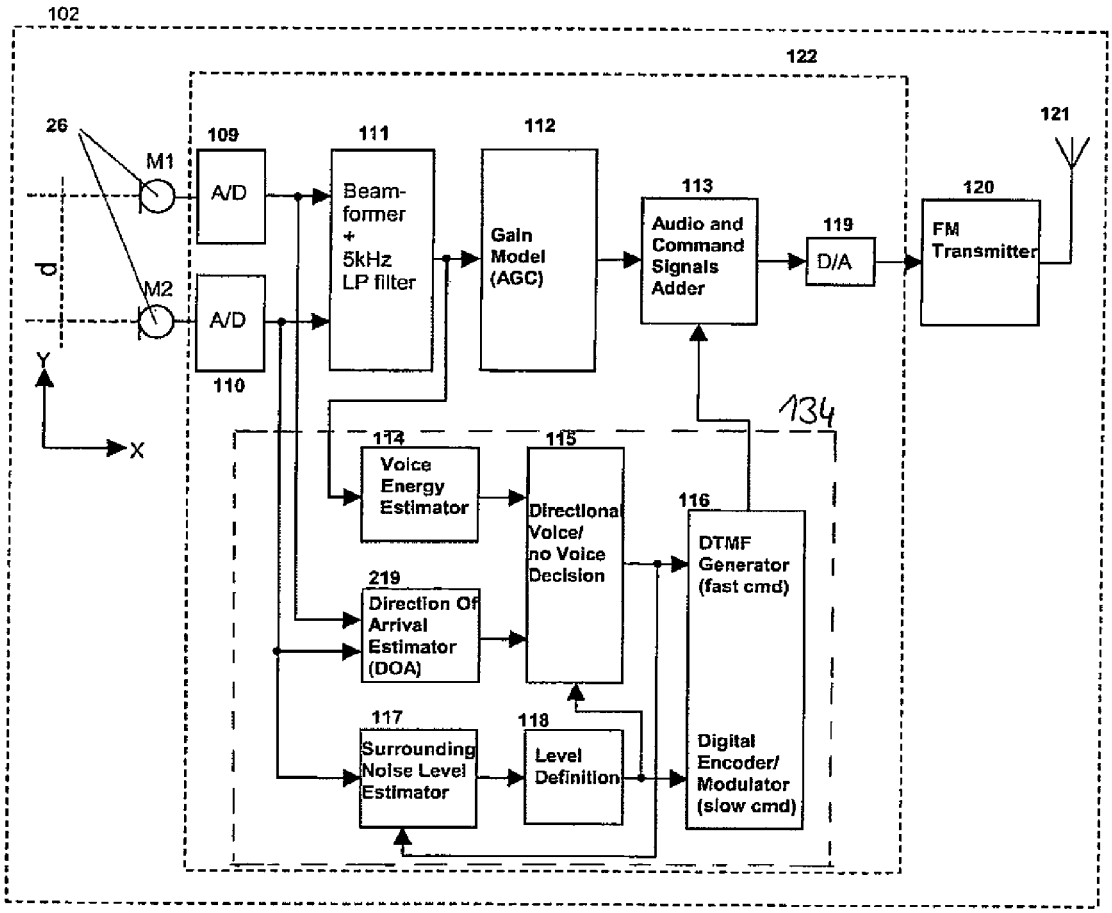
FIG. 4 is a block diagram of the transmission unit of the system of FIG. 1.

The internal architecture of the FM transmission unit 102 is schematically shown in FIG. 4. As already mentioned above, the spaced apart omnidirectional microphones M1 and M2 of the microphone arrangement 26 capture both the speaker's voice 105 and the surrounding noise 106 and produce corresponding audio signals which are converted into digital signals by the analog-to-digital converters 109 and 110. M1 is the front microphone and M2 is the rear microphone. The microphones M1 and M2 together are associated to a beam-former algorithm and form a directional microphone arrangement 26 which, according to FIG. 1, is placed at a relatively short distance to the mouth of the speaker 100 in order to insure a good SNR at the audio source and also to allow the use of easy to implement and fast algorithms for voice detection as will be explained in the following. The converted digital signals from the microphones M1 and M2 are supplied to the unit 111 which comprises a beam-former implemented by a classical beam-former algorithm and a 5 kHz low pass filter. The first audio signals leaving the beam former unit 111 are supplied to a gain model unit 112 which mainly consists of an automatic gain control (AGC) for avoiding an overmodulation of the transmitted audio signals. The output of a gain model unit 112 is supplied to an adder unit 113 which mixes the first audio signals, which are limited to a range of 100 Hz to 5 kHz due to the 5 kHz low pass filter in the unit 111, and data signals supplied from a unit 116 within a range from 5 kHz and 7 kHz. The combined audio/data signals are converted to analog by a digital-to-analog converter 119 and then are supplied to the FM transmitter 120 which uses the neck-loop 121 as an FM radio antenna.

The transmission unit 102 comprises a classification unit 134 which includes units 114, 115, 116, 117, 118 and 219, as will be explained in detail in the following.

The unit 114 is a voice energy estimator unit which uses the output signal of the beam former unit 111 in order to compute the total energy contained in the voice spectrum with a fast attack time in the range of a few milliseconds, preferably not more than 10 milliseconds. By using such short attack time it is ensured that the system is able to react very fast when the speaker 100 begins to speak. The output of the voice energy estimator unit 114 is provided to a voice judgement unit 115.

The input signals to the beam-former unit 111, i.e. the digitized audio signals captured by the microphones M1 and M2, respectively, are also supplied as input to a direction of arrival (DOA) estimator 219 which is provided for estimating, by comparing the audio signals captured by the microphone M1 and the audio signals captured by the microphone M2, the DOA value of the captured audio signals. The DOA value indicates the Direction of Arrival estimated with the phase differences in the audio band of the incoming signal captured by the microphones M1 and M2. The output of the DOA estimator 219, i.e. the estimated DOA value, is provided to the voice judgement unit 115.

The voice judgement unit decides, depending on the signals provided by the voice energy estimator 114 and the DOA estimator 219, whether close voice, i.e. the speaker's voice, is present at the microphone arrangement 26 or not. By basing the judgement both on the total energy in the voice spectrum and the DOA value, the reliability of the judgement is enhanced compared to the prior art approach of EP 1 691 574 A2 wherein the judgement is based only on the total energy in the voice spectrum.

Since the voice detection in the DOA estimator 219 and the voice energy estimator unit 114 is independent of the direct audio path, their outputs can be computed from filtered input signals which may be confined with regard to frequency ranges. Appropriate frequency bands are defined DOA estimator 219 and the voice energy estimator unit 114 with regard to the directivity pattern of the microphones M1, M2 and the beam-former unit 111, and the spectra of voice to be detected and/or the noise signals to be rejected. Thresholds must be adjusted accordingly. Preferably, the DOA estimator 219 and the voice energy estimator unit 114 use only frequencies below 1 kHz. Thereby it can be avoided, for example, that screech sounds generated by a teacher writing in on the blackboard are erroneously detected as the teacher's voice.

The unit 117 is a surrounding noise level estimator unit which uses the audio signal produced by the omnidirectional rear microphone M2 in order to estimate the surrounding noise level present at the microphone arrangement 26. However, it can be assumed that the surrounding noise level estimated at the microphone arrangement 26 is a good indication also for the surrounding noise level present at the ears of the user 101, like in classrooms for example. The surrounding noise level estimator unit 117 is active only if no close voice is presently detected by the voice judgement unit 115 (in case that close voice is detected by the voice judgement unit 115, the surrounding noise level estimator unit 117 is disabled by a corresponding signal from the voice judgment unit 115). A very long time constant in the range of 10 seconds is applied by the surrounding noise level estimator unit 117. The surrounding noise level estimator unit 117 measures and analyzes the total energy contained in the whole spectrum of the audio signal of the microphone M2 (usually the surrounding noise in a classroom is caused by the voices of other pupils in the classroom). The long time constant ensures that only the time-averaged surrounding noise is measured and analyzed, but not specific short noise events. According to the level estimated by the unit 117, a hysteresis function and a level definition is then applied in the level definition unit 118, and the data provided by the level definition unit 118 is supplied to the unit 116 in which the data is encoded by a digital encoder/modulator and is transmitted continuously with a digital modulation having a spectrum a range between 5 kHz and 7 kHz. That kind of modulation allows only relatively low bit rates and is well adapted for transmitting slowly varying parameters like the surrounding noise level provided by the level definition unit 118.

The estimated surrounding noise level definition provided by the level definition unit 118 is also supplied to the voice judgement unit 115 in order to be used to adapt accordingly to it the threshold level for the close voice/no close voice decision made by the voice judgement unit 115 in order to maintain a good SNR for the voice detection.

If close voice is detected by the voice judgement unit 115, a very fast DTMF (dual-tone multi-frequency) command is generated by a DTMF generator included in the unit 116. The DTMF generator uses frequencies in the range of 5 kHz to 7 kHz. The benefit of such DTMF modulation is that the generation and the decoding of the commands are very fast, in the range of a few milliseconds. This feature is very important for being able to send a very fast "voice ON" command to the receiver unit 103 in order to catch the beginning of a sentence spoken by the speaker 100. The command signals produced in the unit 116 (i.e. DTMF tones and continuous digital modulation) are provided to the adder unit 113, as already mentioned above.

The units 109 to 119 all can be realized by the digital signal processor 122 of the transmission unit 102.

The receiver unit 103 is schematically shown in FIG. 5. The audio signals produced by the microphone arrangement 26 and processed by the units 111 and 112 of transmission unit 102 and the command signals produced by the classification unit 134 of the transmission unit 102 are transmitted from the transmission unit 102 over the same FM radio channel to the receiver unit 103 where the FM radio signals are received by the antenna 123 and are demodulated in an FM radio receiver 124. An audio signal low pass filter 125 operating at 5 kHz supplies the audio signals to an amplifier 126 from where the audio signals are supplied to a power audio amplifier 137 which further amplifies the audio signals for being supplied to the loudspeaker 136 which converts the audio signal into sound waves stimulation the user's hearing. The power amplifier 137 is controlled by a manually operable volume control 135. The output signal of the FM radio receiver 124 is also filtered by a high pass filter 127 operating at 5 kHz in order to extract the commands from the unit 116 contained in the FM radio signal. A filtered signal is supplied to a unit 128 including a DTMF decoder and a digital demodulator/decoder in order to decode the command signals from the voice judgement unit 115 and the surrounding noise level definition unit 118.

The command signals decoded in the unit 128 are provided separately to a parameter update unit 129 in which the parameters of the commands are updated according to information stored in an EEPROM 130 of the receiver unit 103. The output of the parameter update unit 129 is used to control the audio signal amplifier 126 which is gain controlled. Thereby the audio signal output of the amplifier 126—and thus the sound pressure level at which the audio signals are reproduced by the loudspeaker 136—can be controlled according to the result of the auditory scene analysis performed in the classification unit 134 in order to control the gain applied to the audio signals from the microphone arrangement 26 of the transmission unit 102 according to the present auditory scene category determined by the classification unit 134.

Figure 6:
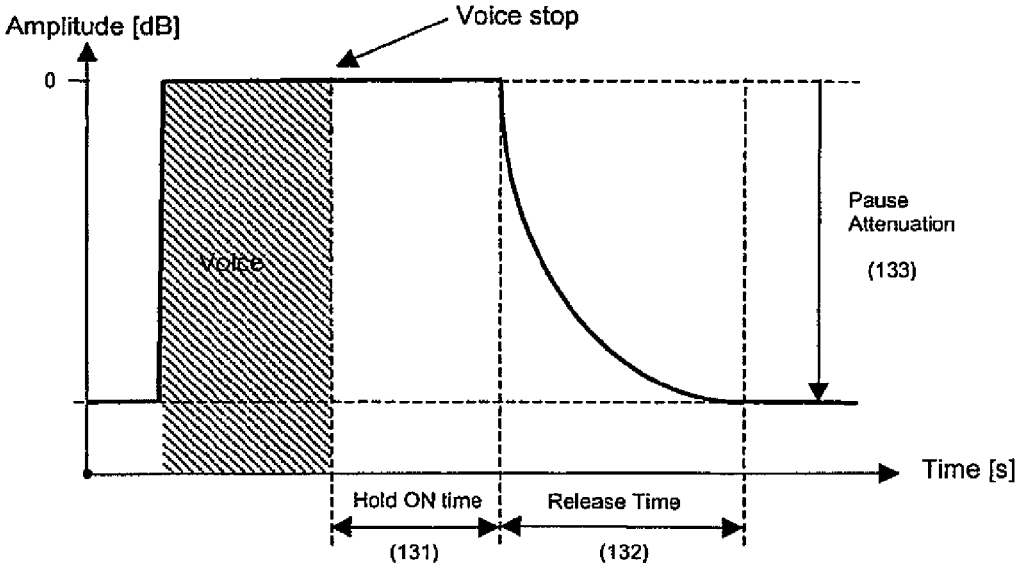
FIG. 6 is a diagram showing an example of the gain set by the gain control unit versus time.

FIG. 6 illustrates an example of how the gain may be controlled according to the determined present auditory scene category.

As already explained above, the voice judgement unit 115 provides at its output for a parameter signal which may have two different values:

"Voice ON": This value is provided at the output if the voice judgement unit 115 has decided that close voice is present at the microphone arrangement 26. In this case, fast DTMF modulation occurs in the unit 116 and a control command is issued by the unit 116 and is transmitted to the amplifier 126, according to which the gain is set to a given value.

"Voice OFF": If the voice judgement unit 115 decides that no close voice is present at the microphone arrangement 26, a "voice OFF" command is issued by the unit 116 and is transmitted to the amplifier 126. In this case, the parameter update unit 129 applies a "hold on time" constant 131 and then a "release time" constant 132 defined in the EEPROM 130 to the amplifier 126. During the "hold on time" the gain set by the amplifier 126 remains at the value applied during "voice ON". During the "release time" the gain set by the amplifier 126 is progressively reduced from the value applied during "voice ON" to a lower value corresponding to a "pause attenuation" value 133 stored in the EEPROM 130. Hence, in case of "voice OFF" the gain of the microphone arrangement 26 is reduced relative to the gain of the microphone arrangement 26 during "voice ON". This ensures an optimum SNR of the sound signals present at the user's ear, since at that time no useful audio signal is present at the microphone arrangement 26 of the transmission unit 102, so that user 101 may perceive ambient sound signals (for example voice from his neighbor in the classroom) without disturbance by noise of the microphone arrangement 26.

The control data/command issued by the surrounding noise level definition unit 118 is the "surrounding noise level" which has a value according to the detected surrounding noise level. As already mentioned above, according to one embodiment the "surrounding noise level" is estimated only during "voice OFF" but the level values are sent continuously over the data link Depending on the "surrounding noise level" the parameter update unit 129 controls the amplifier 126 such that according to the definition stored in the EEPROM 130 the amplifier 126 applies an additional gain offset to the audio signals sent to the power amplifier 137. According to alternative embodiments, the "surrounding noise level" is estimated only or also during "voice ON". In these cases, during "voice ON", the parameter update unit 129 controls the amplifier 126 depending on the "surrounding noise level" such that according to the definition stored in the EEPROM 130 the amplifier 126 applies an additional gain offset to the audio signals sent to the power amplifier 137.

The difference of the gain values applied for "voice ON" and "voice OFF", i.e. the dynamic range, usually will be less than 20 dB, e.g. 12 dB.

In all embodiments, the present auditory scene category determined by the classification unit 134 may be characterized by a classification index.

In general, the classification unit will analyze the audio signals produced by the microphone arrangement 26 of the transmission unit 102 in the time domain and/or in the frequency domain, i.e. it will analyze at least one of the following: amplitudes, frequency spectra and transient phenomena of the audio signals.

Figure 7:
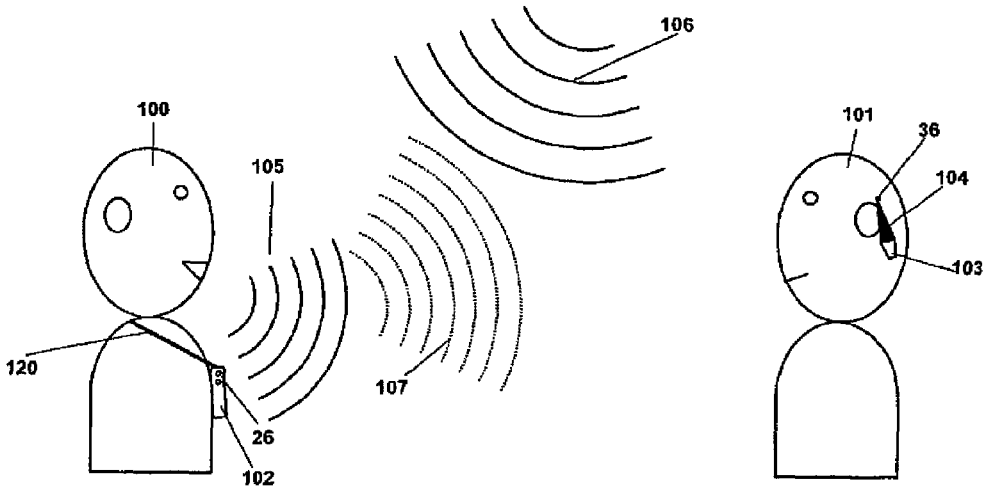
FIG. 7 is a schematic view of the use of a second embodiment of a hearing assistance system according to the invention.

FIG. 7 shows schematically the use of an alternative embodiment of a system for hearing assistance, wherein the receiver unit 103 worn by the user 101 does not comprise an electroacoustic output transducer but rather it comprises an audio output which is connected, e.g. by an audio shoe (not shown), to an audio input of a hearing instrument 104, e.g. a hearing aid, comprising a microphone arrangement 36. The hearing aid could be of any type, e.g. BTE (Behind-the-ear), ITE (In-the-ear) or CIC (Completely-in-the-channel).

Figure 8:
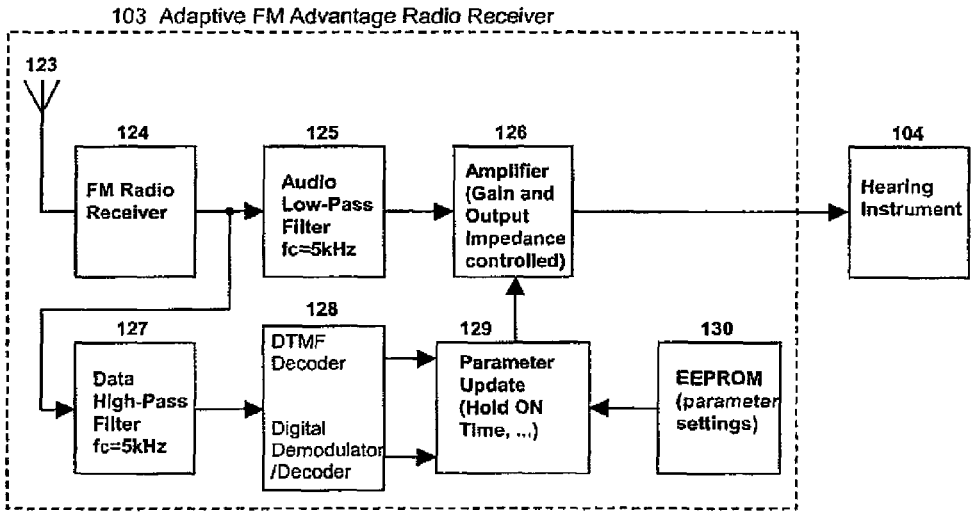
FIG. 8 is a block diagram of the receiver unit of the system of FIG. 7.

In FIG. 8 a block diagram of the receiver unit 103 connected to the hearing instrument 104 is shown. Apart from the features that the amplifier 126 is both gain and output impedance controlled and that the power amplifier 137, the volume control 135 and the loudspeaker 136 are replaced by an audio output, the architecture of the receiver unit 103 of FIG. 8 corresponds to that of FIG. 7.

Figure 9:
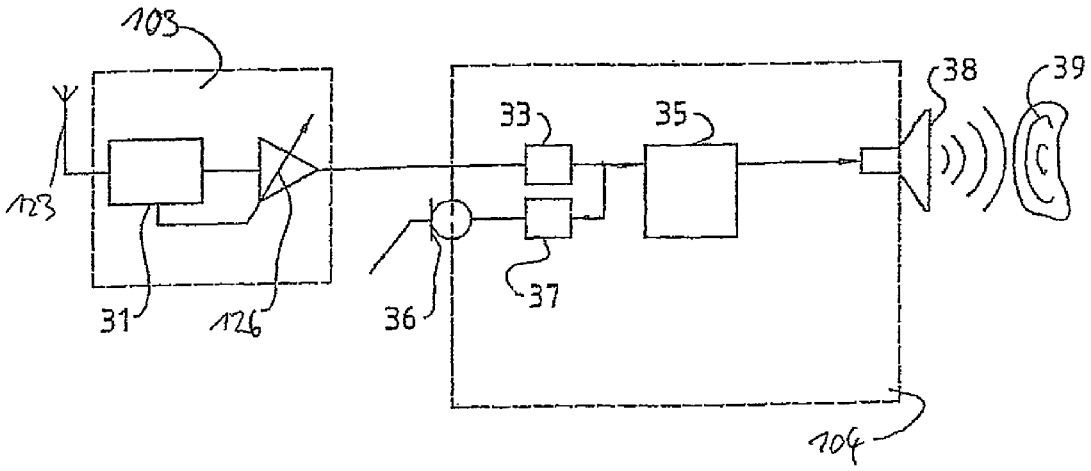
FIG. 9 shows schematically an example in which the receiver unit is connected to a separate audio input of a hearing instrument.

FIG. 9 is a block diagram of an example in which the receiver unit 103 is connected to a high impedance audio input of the hearing instrument 104. In FIG. 9 the signal processing units of the receiver unit 103 of FIG. 8 are schematically represented by a module 31. The processed audio signals are amplified by the variable gain amplifier 126. The output of the receiver unit 103 is connected to an audio input of the hearing instrument 104 which is separate from the microphone 36 of the hearing instrument 104 (such separate audio input has a high input impedance).

The first audio signals provided at the separate audio input of the hearing instrument 104 may undergo pre-amplification in a pre-amplifier 33, while the audio signals produced by the microphone 36 of the hearing instrument 104 may undergo pre-amplification in a pre-amplifier 37. The hearing instrument 104 further comprises a digital central unit 35 into which the audio signals from the microphone 36 and the audio input are supplied as a mixed audio signal for further audio signal processing and amplification prior to being supplied to the input of the output transducer 38 of the hearing instrument 104. The output transducer 38 serves to stimulate the user's hearing 39 according to the combined audio signals provided by the central unit 35.

Since pre-amplification in the pre-amplifiers 33 and 37 is not level-dependent, the receiver unit 103 may control—by controlling the gain applied by the variable gain amplifier 126—also the ratio of the gain applied to the audio signals from the microphone arrangement 26 and the gain applied to the audio signals from the microphone 36.

Figure 10:
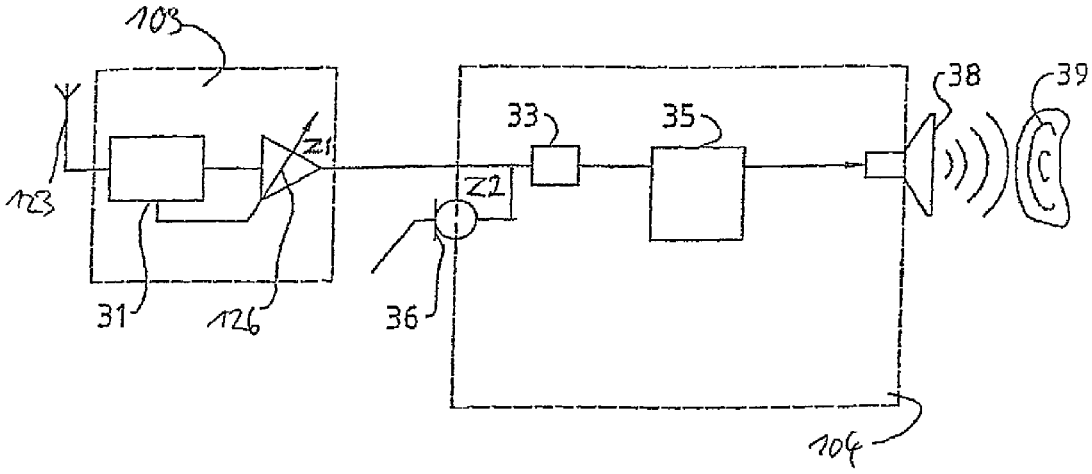
FIG. 10 shows schematically an example in which the receiver unit is connected in parallel to the microphone arrangement of a hearing instrument.

FIG. 10 shows a modification of the embodiment of FIG. 9, wherein the output of the receiver unit 103 is not provided to a separate high impedance audio input of the hearing instrument 104 but rather is provided to an audio input of the hearing instrument 104 which is connected in parallel to the hearing instrument microphone 36. Also in this case, the audio signals from the remote microphone arrangement 26 and the hearing instrument microphone 36, respectively, are provided as a combined/mixed audio signal to the central unit 35 of the hearing instrument 104. The gain for the audio signals from the receiver unit 103 and the microphone 36, respectively, can be controlled by the receiver unit 103 by accordingly controlling the signal at the audio output of the receiver unit 103 and the output impedance Z1 of the audio output of the receiver unit 103, i.e. by controlling the gain applied to the audio signals by the amplifier 126 in the receiver unit 103.

The transmission unit to be used with the receiver unit of FIG. 8 corresponds to that shown in FIG. 4. In particular, also the gain control scheme applied by the classification unit 134 of the transmission unit 102 may correspond to that shown in FIG. 6.

The permanently repeated determination of the present auditory scene category and the corresponding setting of the gain allows to automatically optimize the level of the first audio signals and the second audio signals according to the present auditory scene. For example, if the classification unit 134 detects that the speaker 100 is silent, the gain for the audio signals from the remote microphone 26 may be reduced in order to facilitate perception of the sounds in the environment of the hearing instrument 104—and hence in the environment of the user 101. If, on the other hand, the classification unit 134 detects that the speaker 100 is speaking while significant surrounding noise around the user 101 is present, the gain for the audio signals from the microphone 26 may be increased and/or the gain for the audio signals from the hearing instrument microphone 36 may be reduced in order to facilitate perception of the speaker's voice over the surrounding noise.

Attenuation of the audio signals from the hearing instrument microphone 36 is preferable if the surrounding noise level is above a given threshold value (i.e. noisy environment), while increase of the gain of the audio signals from the remote microphone 26 is preferable if the surrounding noise level is below that threshold value (i.e. quiet environment). The reason for this strategy is that thereby the listening comfort can be increased.

While in the above embodiments the receiver unit 103 and the hearing instrument 104 have been shown as separate devices connected by some kind of plug connection (usually an audio shoe) it is to be understood that the functionality of the receiver unit 103 also could be integrated with the hearing instrument 104, i.e. the receiver unit and the hearing instrument could form a single device.

Figure 11:
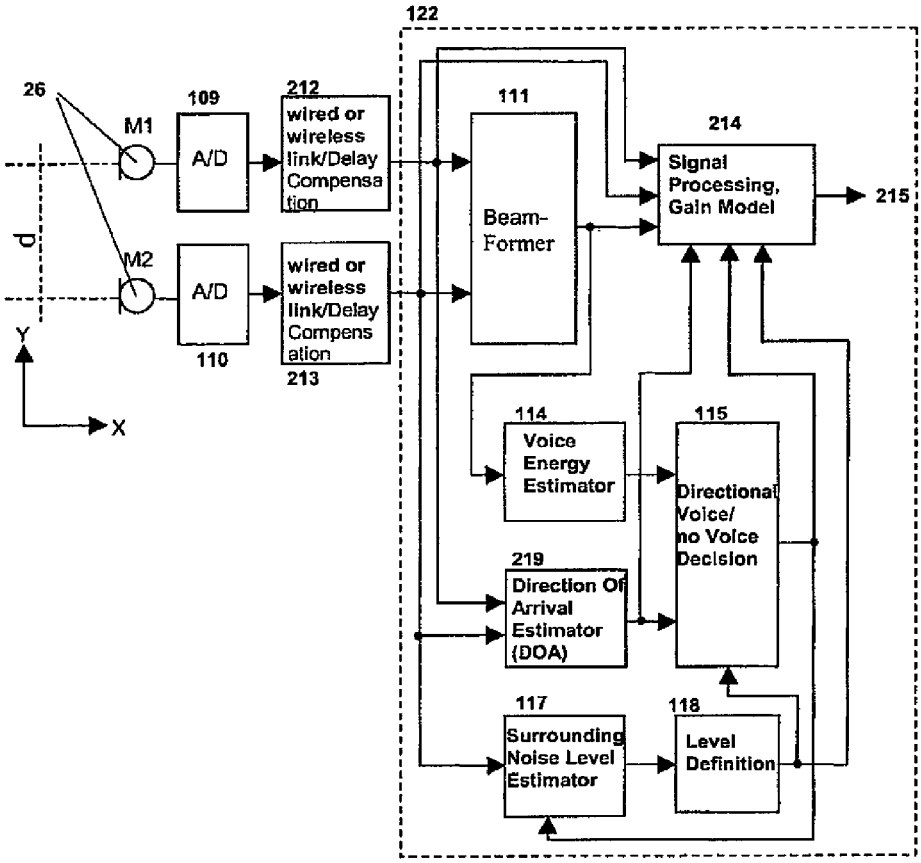
FIG. 11 is a block diagram of a voice activity detector (VAD) according to the invention suitable also for applications other than that of FIG. 4.

FIG. 11 is a block diagram of a VAD, which is suitable also for applications other than in the transmission unit of the wireless system of FIG. 4, such as in a monaural or binaural hearing instrument system. The audio signals generated by the microphones M1 and M2 of the microphone arrangement 26 may be supplied, after having been digitized in the converters 109 and 110, respectively, to a digital signal processor (DSP) 122 via a link 212 and 213, respectively, which may be wired or wireless. If one of the links 212, 213 introduces a delay of the transmitted audio signal with regard to the other one of the links 212, 213, a delay compensation will be included in the links 212, 213, usually by delaying the "faster" link accordingly (for example, a wireless link usually involves a signal delay compared to a wired link).

The distance between the microphones M1 and M2 of the microphone arrangement 26 may vary from a few mm to 20 cm (the latter corresponds to the ear-to-ear distance). Thus, the microphones M1, M2 may be provided at the same ear, or they may be provided at different ears in order to achieve maximum separation in space for enabling particularly efficient beam forming.

The input signals provided via the links 212 and 213 are supplied to a beam-former unit 111 including a beam former implemented by a classical beam former algorithm and a low pass filer, for example, a 5 kHz low pass filter. The audio signals leaving the beam former unit 111 are supplied to an audio signal processing unit 214 which also may include a gain model. The audio signal processing unit 214 also may receive, as additional input, the original input audio signals provided by the links 212 and 213.

The output of the beam former unit 111 also is supplied to a voice energy estimator unit 114, which is provided for computing the total energy contained in the voice spectrum in the same manner as the unit 114 of the embodiment of FIG. 4.

The original audio input signals provided by the links 212 and 213 are also supplied to a DOA estimator 219 which determines the DOA value of the input audio signals, for example, by considering the phase difference between the two audio channels.

The input audio signals of at least one of the links 212 and 213 are supplied to a surrounding noise level estimator unit 117 which produces an output signal supplied to a level definition unit 118. The units 117 and 118 correspond to the unit 117 and 118 of the embodiment of FIG. 4.

The output signal of the voice energy estimator unit 114, the DOA estimator 219 and the level definition unit 118 are supplied as input to a voice judgement unit 115, which, based on these input signals, decides whether there is a voice source present close to the microphone arrangement 26 or not. The surrounding noise level estimator unit 117 is active only if close voice has not been detected.

In general, the interaction and the functionality of the units 111, 114, 115, 117, 118 and 219 is essentially the same as in the embodiment of FIG. 4.

The output of the voice judgement unit 115 is supplied to the audio signal processing unit 214 in order to control the processing of the audio signals in the unit 214 depending on whether close voice has been detected or not. Thereby the parameters of the audio signal processing procedure, i.e. the audio signal processing mode, can be selected accordingly so that the audio signal processing parameters can be optimized with regard to the presently prevailing auditory scene. In addition to the yes/no signal provided by the voice judgement unit 115, the audio signal processing unit 214 may be provided with the output signal of the DOA estimator 219 and the level definition unit 118 in order to more precisely adapt the audio signal processing procedure to the presently prevailing auditory scene.

The audio signals processed by the unit 214 may be supplied as audio signals 215 to the stimulating means (typically a loudspeaker) of a hearing instrument.

One example of an application of the system of FIG. 11 is a monaural hearing instrument system. In this case, the microphones M1 and M2 would be part of the same hearing instrument, and the stimulating means for the audio signals 215 also would be part of the same hearing instrument.

Figure 12:
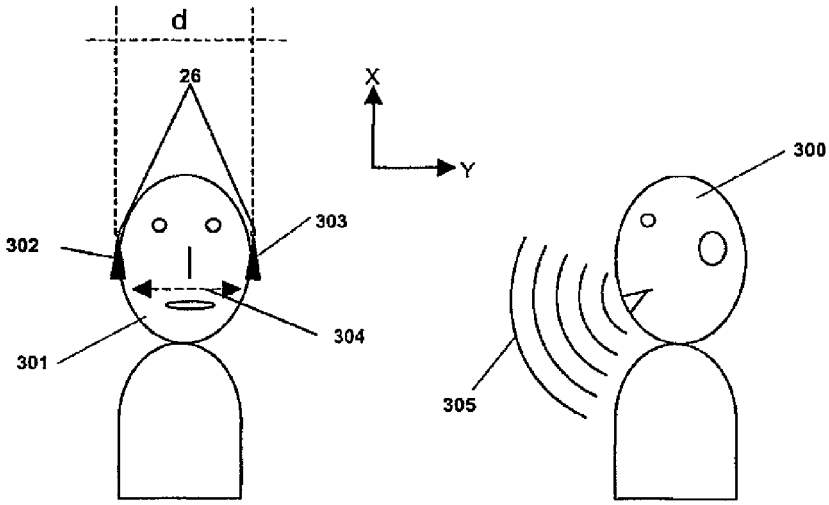
FIG. 12 is a schematic view of the use of a third embodiment of a hearing assistance system according to the invention.
Figure 13:
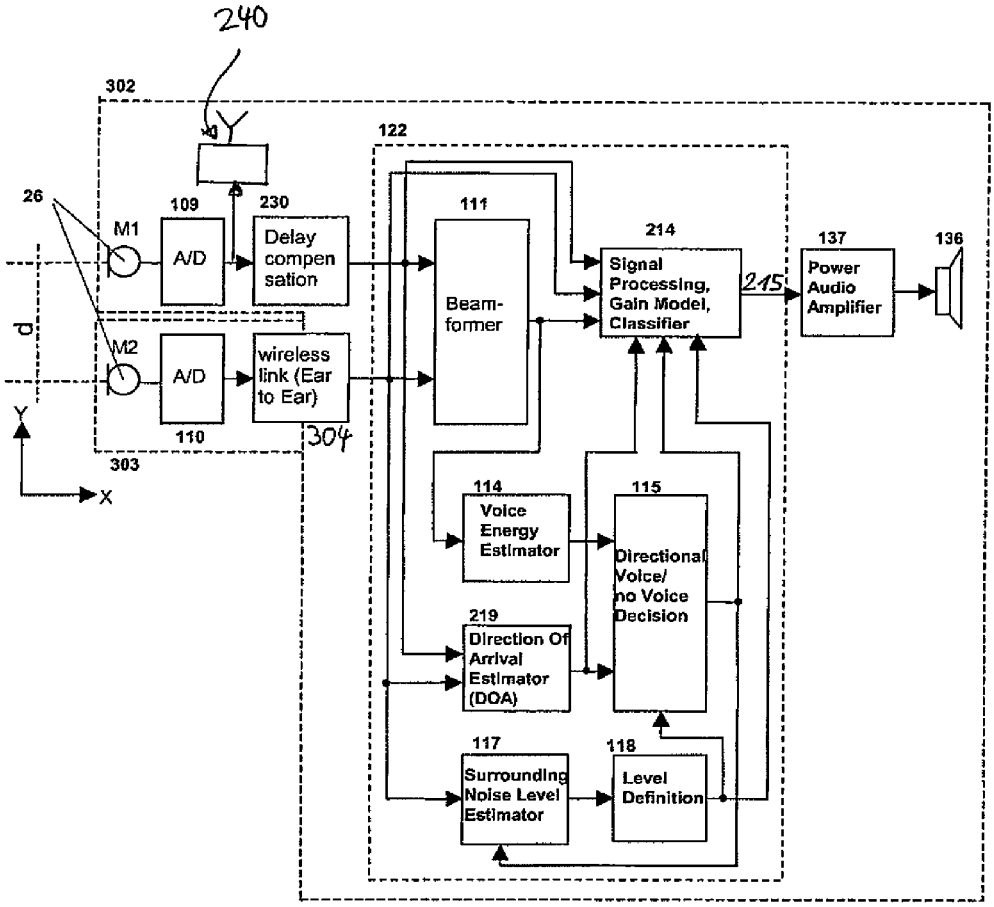
FIG. 13 is a block diagram of one of the hearing instruments of FIG. 12.

An example of an application relating to a binaural hearing aid system comprising a right ear hearing aid 302 and a left ear hearing aid 303 worn at the right ear and left ear, respectively, of a user 301 is shown in FIGS. 12 and 13.

In FIG. 12 the use of such a binaural system is schematically shown, with the hearing aids 302 and 303 being separated by the ear-to-ear distance d (which corresponds to about 20 cm) and with the microphone M1 of the right ear hearing aid 302 and the microphone M2 of the left ear hearing aid 303 forming the microphone arrangement 26 of two microphones spaced apart by the distance d. The voice 305 of a speaker 300 is captured both at the microphone M1 and the microphone M2. The hearing aids 302 and 303 are provided with means for establishing a wireless audio signal link 304 between them for exchanging audio signals captured by the microphones M1 and M2. The link 304 may be an inductive link.

In FIG. 13 a block diagram of the right ear hearing aid 302 is shown. The functionality implemented by the DSP 122 corresponds to that shown in FIG. 11, i.e. the units 111, 114, 115, 117, 118, 214 and 219 correspond to that of FIG. 11. The audio signals captured by the microphone M1 are digitized in the converter 109 and undergo a delay compensation in a delay compensation unit 230 prior to being supplied as input to the DSP 122. The audio signals captured by the microphone M2 of the left ear hearing aid 303 are digitized by a converter 110 of the left ear hearing aid 303 and then are transmitted via the wireless audio link 304 to the right ear hearing aid 302 where they are received and, after demodulation, are supplied as input audio signals to the DSP 122. Thus, like in the embodiments of FIG. 4 and FIG. 11, the audio signals captured by the microphone M1 represent one of the audio input channels to the DSP 122 and the audio signals captured by the microphone M2 represent the other audio signal input channel. The delay compensation unit 230 is provided for compensating the delay introduced by the wireless audio link 304, thereby enabling phase analysis of the audio signals provided by the microphones M1 and M2 for beam forming and DOA estimation and for other audio signal processing in the unit 214.

As shown in FIG. 13, the audio signal processing unit 214, which may include a gain model and an auditory scene classifier, may be supplied with the original audio signals from the microphones M1 and M2 and with the output of the beam former unit 111. Also the beam former unit is supplied with the audio signals from the microphones M1 and M2 as the input. As in the embodiment shown in FIG. 11, the audio signal processing unit 214 is controlled by the output of the DOA estimator 219, the output of the level definition unit 118 and the output of the voice judgement unit 115.

The processed audio signals 215 produced by the unit 214 are supplied to a power audio amplifier 137 and are reproduced by the loudspeaker 136 of the right ear hearing aid 302.

The left ear hearing aid 303 has an architecture which is analog to that of the right ear hearing aid 302 shown in FIG. 13, i.e. the left ear hearing aid 303 receives the audio signals captured by the microphone M1 of the right ear hearing aid 302 via the wireless audio signal link 304 and it uses the audio signals captured by the microphone M2 of the left ear hearing aid 302 as direct input. The transmitter for transmitting the audio signals captured by the microphone M1 of the right ear hearing aid 302 via the audio link 304 is shown schematically at 240 in FIG. 13.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

The invention claimed is:

1. A method for providing hearing assistance to a user, comprising:

capturing audio signals by a microphone arrangement comprising at least two spaced apart microphones;

estimating a total energy contained in a voice spectrum of the audio signals captured at at least one of the microphones;

estimating a value of the direction of arrival of the captured audio signals by comparing the audio signals captured by at least two of the spaced apart microphones;

judging whether a voice is present close to the microphone arrangement by taking into account the estimated total energy contained in the voice spectrum of the captured audio signals and the estimated value of the direction of arrival of the captured audio signals;

outputting a signal representative of said judgement;

processing said captured audio signals according to said signal representative of said judgement;

transmitting the audio signals by a transmission unit via a wireless audio link to a receiver unit comprising a gain control unit, and setting by said on control unit in said audio signal processing, a gain applied to the audio signals according to said signal representative of said judgement; and stimulating the user's hearing, by stimulating means worn at or in at least one of the user's ears, according to the processed audio signals;

wherein a classification unit is provided in the transmission unit for performing said total voice energy estimation, said direction of arrival estimation, said close voice judgement and said judgement signal output.

2. The method of claim 1, wherein the captured audio signals undergo acoustic beam-forming prior to being used for estimating the total energy contained in the voice spectrum of the audio signals.

3. The method of claim 1, wherein a noise level surrounding the microphone arrangement is estimated from the audio signals captured at at least one of the microphones and wherein said surrounding noise level estimation is used in said processing of the captured audio signals.

4. The method of claim 3, wherein the surrounding noise level estimation is performed only if it has been judged that there is no close voice captured by the microphone arrangement.

5. The method of claim 1, wherein the transmission unit comprises the microphone arrangement.

6. The method of claim 1, wherein the classification unit produces control commands according to said close voice judgement for controlling the gain control unit, with the control commands being transmitted via a wireless data link from the transmission unit to the receiver unit.

7. The method of claim 6, wherein the control commands produced by the classification unit are added in an adder unit to the audio signals prior to being transmitted by the transmission unit.

8. The method of claim 6, wherein the wireless data link and the audio link are realized by a common transmission channel.

9. The method of claim 8, wherein a lower portion of a bandwidth of the transmission channel is used by the audio link and an upper portion of the bandwidth of the channel is used by the data link.

10. The method of claim 1, wherein the stimulating means is part of the receiver unit or is directly connected thereto.

11. The method of claim 10, wherein the gain control unit comprises an amplifier which is gain controlled.

12. The method of claim 1, wherein the receiver unit is part of a hearing instrument comprising the stimulating means.

13. The method of claim 12, wherein the hearing instrument comprises a second microphone arrangement for capturing second audio signals and means for mixing the second audio signals and the audio signals from the gain control unit.

14. The method of claim 13, wherein the hearing instrument includes means for processing the mixed audio signals prior to being supplied to the stimulating means.

15. The method of claim 12, wherein the gain control unit comprises an amplifier which is gain and output impedance controlled.

16. The method of claim 15, wherein the amplifier of the gain control unit acts on the audio signals received by the receiver unit in order to dynamically increase or decrease a level of said audio signals as long as a classification unit determines a surrounding noise level below a given threshold.

17. The method of claim 16, wherein the gain control unit acts to dynamically attenuate the second audio signals as long as the classification unit determines a surrounding noise level above a given threshold.

18. The method of claim 17, wherein the gain control unit acts to change an output impedance and an amplitude of the receiver unit in order to attenuate the second audio signals, with an output of the receiver unit being connected in parallel with the second microphone arrangement.

19. The method of claim 1, wherein the receiver unit is connected to a hearing instrument comprising the stimulating means.

20. The method of claim 1, wherein the estimated surrounding noise level is taken into account in said setting of said gain applied to the audio signals.

21. The method claim 1, wherein the gain control unit sets the gain to a first value if the presence of close voice at the microphone arrangement is judged and to a second value if lack of close voice at the microphone arrangement is judged, with the second value being lower than the first value.

22. The method of claim 21, wherein the first value is changed by the gain control unit according to the estimated surrounding noise level.

23. The method of claim 21, wherein the gain control unit reduces the gain progressively from the first value to the second value during a given release time period if a change from close voice at the microphone arrangement to no close voice at the microphone arrangement is judged.

24. The method of claim 23, wherein the gain control unit keeps the gain at the first value for a given hold-on time period if a change from close voice at the microphone arrangement to no close voice at the microphone arrangement is judged, prior to progressively reducing the gain from the first value to the second value during a release time period.

25. The method of claim 1, wherein the audio signals undergo an automatic gain control treatment in a gain model unit prior to being transmitted to the receiver unit.

26. The method of claim 1, wherein at least one of the microphones of the microphone arrangement is worn at or in a user's right ear and at least one of the microphones of the microphone arrangement is worn at or in a user's left ear.

27. The method of claim 26, wherein at least one of the microphones of the microphone arrangement is part of a right hearing instrument worn at or in the user's right ear and at least one of the microphones of the microphone arrangement is part of a left hearing instrument worn at or in the user's left ear.

28. The method of claim 27, wherein the audio signals captured by the microphone(s) of each of the hearing instruments are transmitted via a wireless audio link to the respective other one of the hearing instruments.

29. The method of claim 28, wherein a delay of the audio signals received via the wireless audio link with regard to the directly captured audio signals is compensated by delaying the directly captured audio signals accordingly.

30. The method of claim 26, wherein the captured audio signals undergo acoustic beam-forming prior to said audio signal processing, with each of said hearing instruments comprising part of said stimulating means.

31. The method of claim 1, wherein in said estimating of the total energy contained in the voice spectrum of the audio signals captured at at least one of the microphones and in said estimating the value of the direction of arrival of the captured audio signals the audio signals are used after having been low-pass filtered.

32. A system for providing hearing assistance to a user, comprising:

a microphone arrangement for capturing audio signals comprising at least two spaced apart microphones;

means for estimating a total energy contained in a voice spectrum of the captured audio signals;

means for estimating a value of the direction of arrival of the captured audio signals by comparing the audio signals captured by at least two of the spaced apart microphones;

means for judging whether a voice is present close to microphone arrangement by taking into account the estimated total energy contained in the voice spectrum of the captured audio signals and the estimated value of the direction of arrival of the captured audio signals;

means for outputting a signal representative of said judgement;

means for processing said captured audio signals according to said signal representative of said judgement;

means for transmitting the audio signals via a wireless audio link;

means for receiving the audio signals, comprising a gain control unit for setting a gain applied to the audio signals according to said signal representative of judgement; and and means to be worn at or in at least one of a user's ears for stimulating a hearing of the user according to the processed audio signals, wherein said transmission means comprises a classification means for performing said total voice energy estimation, said direction of arrival estimation, said close voice judgement and said judgement signal output.

33. The system of claim 32, further comprising an acoustic beam-former for applying an acoustic beam-forming algorithm to the captured audio signals prior to being supplied to the means for estimating the total energy contained in the voice spectrum of the captured audio signals.

34. The system of claim 32, further comprising means for estimating a noise level surrounding the user from the captured audio signals, said noise level estimation being used by said audio signal processing means.

* * * * *